United States Patent [19]

Thomas

[11] 4,400,675

[45] Aug. 23, 1983

[54] TRANSFORMER WITH IMPEDANCE MATCHING MEANS

[75] Inventor: Michael W. Thomas, Marshall Township, Allegheny County, Pa.

[73] Assignee: Westinghouse Electric Corp., Pittsburgh, Pa.

[21] Appl. No.: 318,508

[22] Filed: Nov. 5, 1981

[51] Int. Cl.[3] ..... H01F 17/06; H01F 27/24

[52] U.S. Cl. ..... 336/160; 336/84 M; 336/212; 336/183; 336/233

[58] Field of Search ..... 336/5, 10, 12, 84 R, 336/84 M, 160, 165, 212, 233, 234, 183

[56] References Cited

U.S. PATENT DOCUMENTS

| | | | |
|---|---|---|---|
| 1,347,910 | 7/1920 | Peters | 336/165 X |
| 2,519,224 | 8/1950 | Chiles, Jr. et al. | 336/84 M X |
| 3,848,331 | 11/1974 | Paulik et al. | 336/233 X |
| 3,948,690 | 4/1976 | Paulik et al. | 336/233 X |
| 4,060,784 | 11/1977 | Fergestad | 336/84 R |
| 4,356,468 | 10/1982 | van Laar | 336/84 R X |

*Primary Examiner*—Thomas J. Kozma
*Attorney, Agent, or Firm*—L. P. Johns

[57] ABSTRACT

A transformer characterized by groups of low voltage and high voltage windings inductively related to a core member, and a shunt of magnetizable microlaminations disposed between the low and high voltage windings, whereby the shunts independently adjust the transformer impedance.

8 Claims, 5 Drawing Figures

FIG. 4.
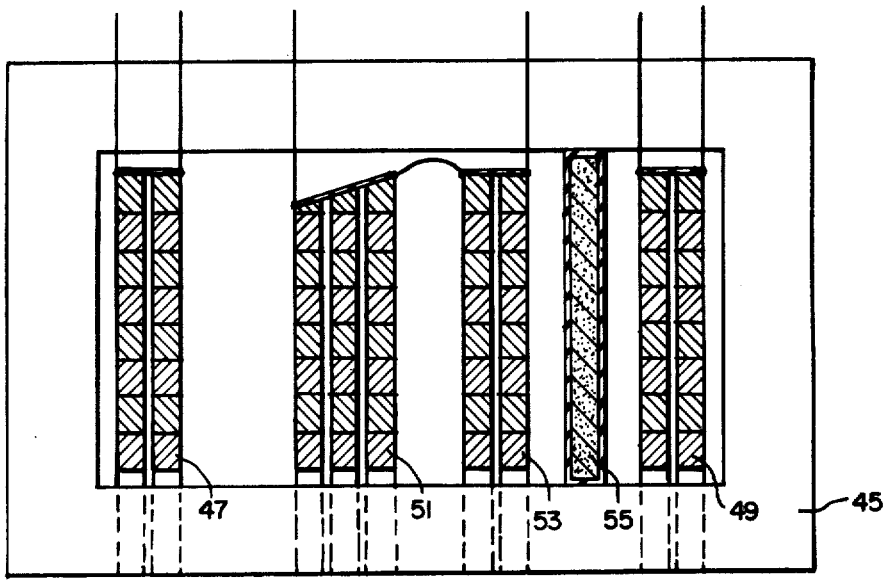
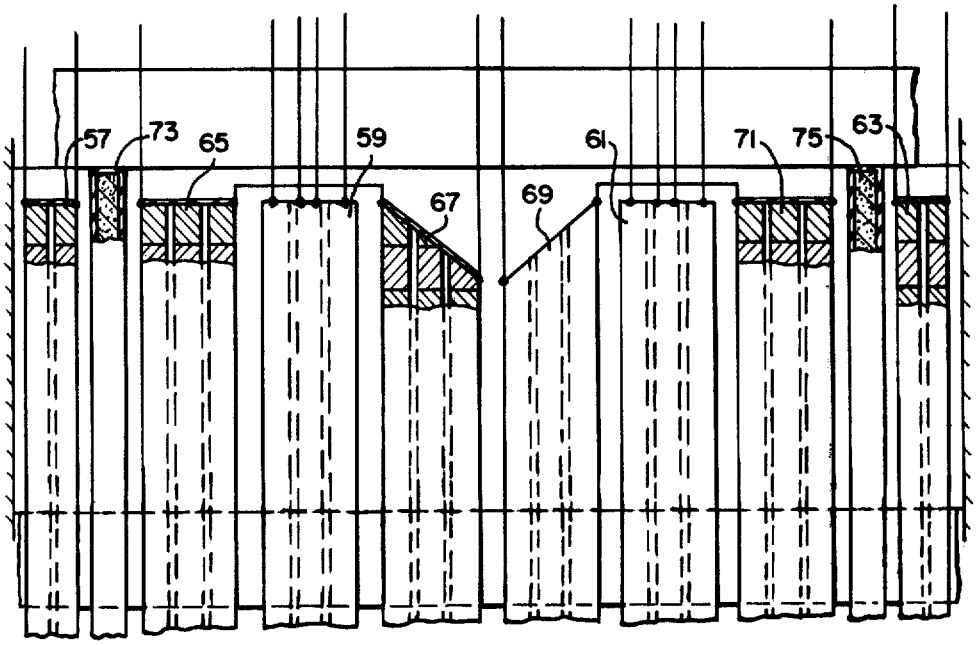
FIG. 5.

TRANSFORMER WITH IMPEDANCE MATCHING MEANS

BACKGROUND OF THE INVENTION

1. Field of the Invention

This invention relates to a transformer phase having suitable magnetic material placed between the windings to adjust the impedance independently of other design variables.

2. Description of the Prior Art

In general, power transformers are designed to meet an impedance specified by the purchaser. The impedance level is set based on power system requirements and is usually higher than desirable for an optimum transformer design in terms of cost plus loss evaluation. High impedances usually require a higher than optimum number of winding turns. It would be desirable to have a winding where the desired impedance could be obtained independently from the number of turns. Because the impedance of a power transformer is almost purely reactive, the resistance portion is ignored and impedance is equated to reactance.

SUMMARY OF THE INVENTION

It has been found in accordance with this invention that magnetic material may be used to adjust a transformer impedance independently of other design variables by a transformer comprising a core member, groups of sectioned low voltage windings and of high voltage windings inductively related to the core member, a shunt of magnetic material between each group of low voltage windings and the high voltage windings, each shunt comprising microlaminations of magnetic material, and each shunt being insulated.

The advantage of the structure of this invention is that it enables specified transformer impedances to be met with a phase design closer to the optimum design. As a result, transformers may be produced with lower cost and/or lower losses and with additional design flexibility for impedance matching.

BRIEF DESCRIPTION OF THE DRAWINGS

FIG. 4 is a sectional view, partially in plan, of a three-winding transformer with a shunt between low voltage and tertiary voltage coils to balance the impedance; and FIG. 5 is a sectional view, partially in plan, of a six high-low coil arrangement with shunts in outside groups to balance the impedance.

DESCRIPTION OF THE PREFERRED EMBODIMENT

Figure 1:
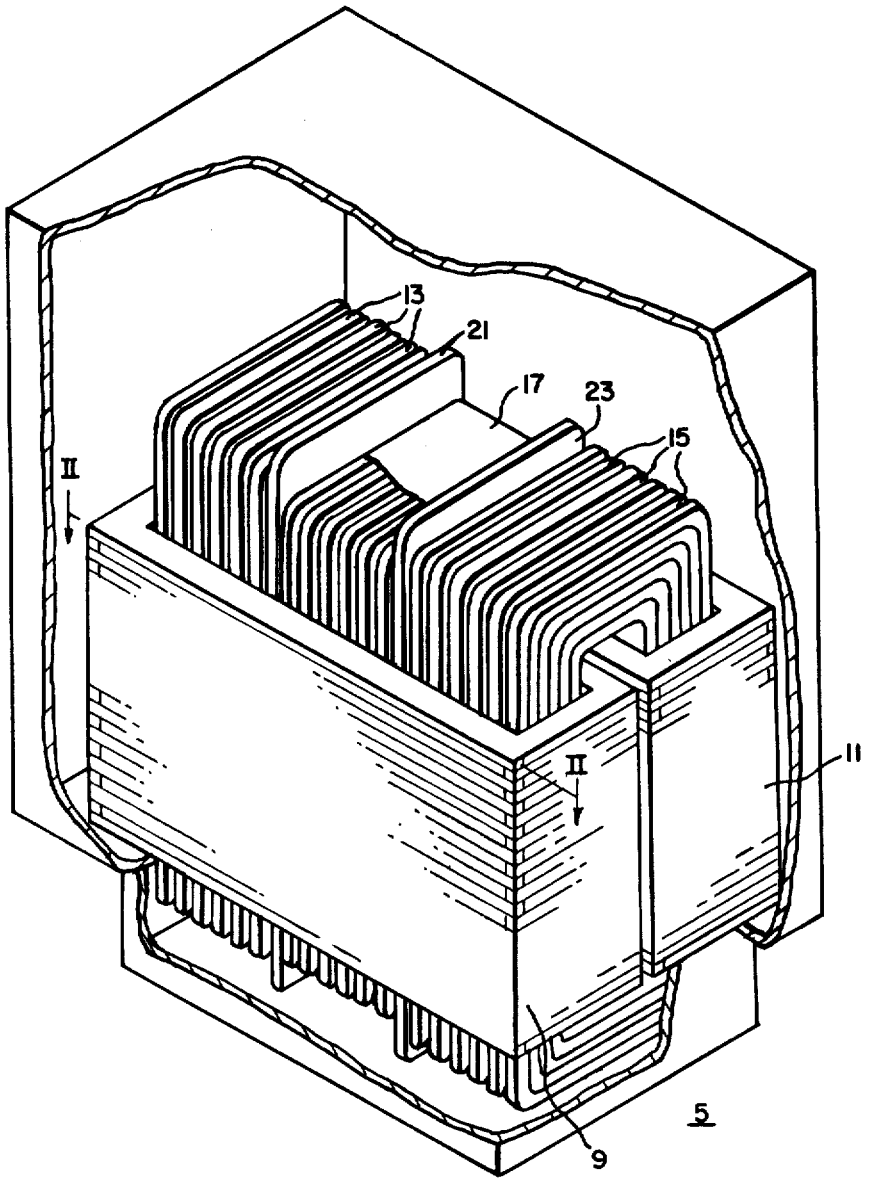
FIG. 1 is an isometric view of a shell-type transformer in accordance with this invention.
Figure 2:
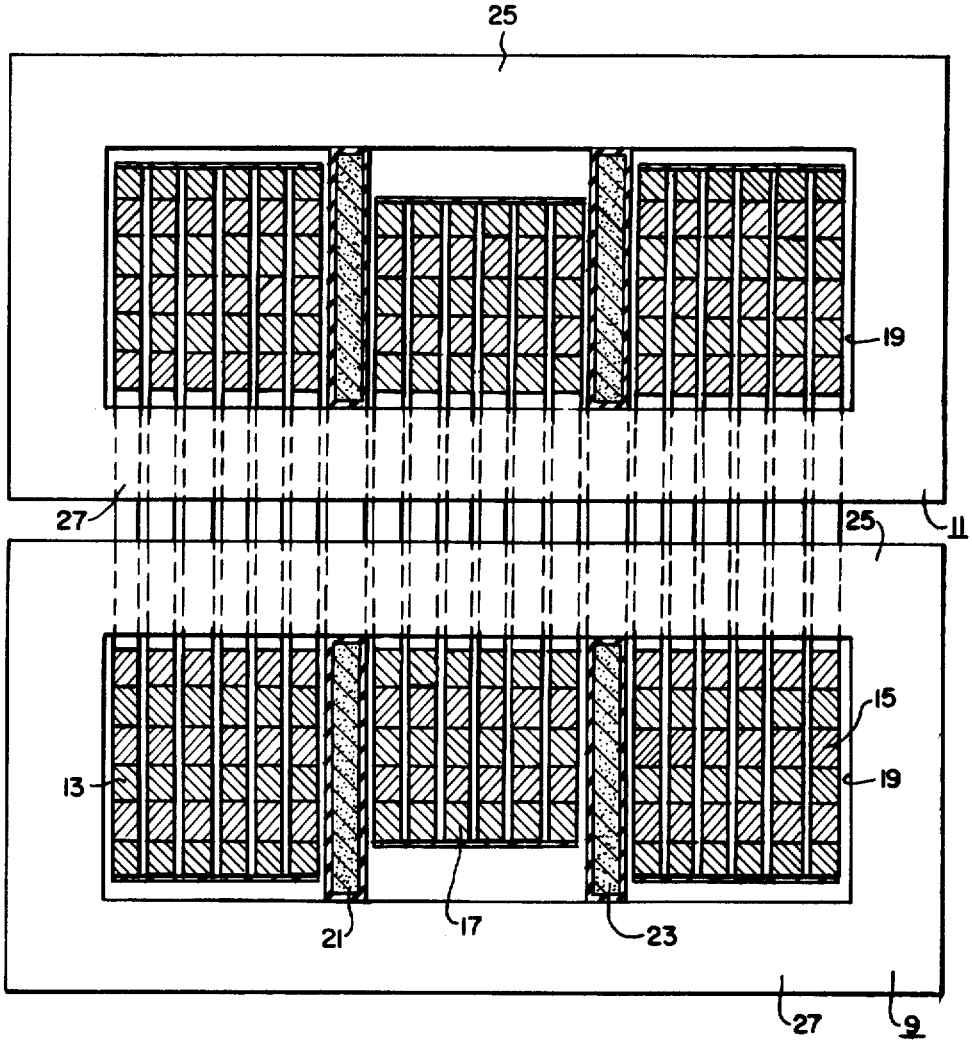
FIG. 2 is a horizontal sectional view, partially in plan, taken on the line 2—2 of FIG. 1.

In FIG. 1 a transformer 5 comprises a metal tank 7 and electrical inductive apparatus of the shell-type including two cores 9, 11, spaced groups of low-voltage coils or windings 13, 15 and a group of high-voltage coils or windings 17. Both cores 9, 11 comprise a plurality of butt-jointed laminations of high permeability material in a conventional manner. The cores 9, 11 include singular windows 19 (FIG. 2) through which the windings 13, 15, 17 extend.

The low-voltage windings 13, 15 are disposed on opposite sides of the high-voltage windings 17. The windings 13, 15, 17 are preferably of the pancake type and form separate groups of sectioned low voltage and high voltage windings that are inductively related to the cores 9, 11.

In accordance with this invention shunts 21 and 23 are located in the windows 19. The shunt 21 is in a space between the windings 13 and 17 and the shunt 23 is between the windings 17 and 15. The shunts 21, 23 are generally coextensive with and have configurations substantially similar to the windings 13, 15, 17; that is, the shunts are flat discs and extend across the windows between spaced yokes 25, 27 to completely separate the adjacent windings.

The shunts 21, 23 are comprised of magnetic material. The preferred magnetic material is microlaminations of suitable ferromagnetic metal or alloy, such as disclosed in U.S. Pat. Nos. 3,848,331 and 3,948,690. More particularly, the shunts 21, 23 are discs of pressed microlaminations with or without a suitable bonding substance. Each shunt is preferably insulated for corona insulation between the adjacent windings 13, 17 and 15, 17. The effective resistance of the shunts must be high enough to prevent current flow around the shunt loop or disc. The reluctance of the magnetic loop must also be controlled to prevent saturation. Shunts with microlaminations readily meet both of these requirements.

Figure 3:
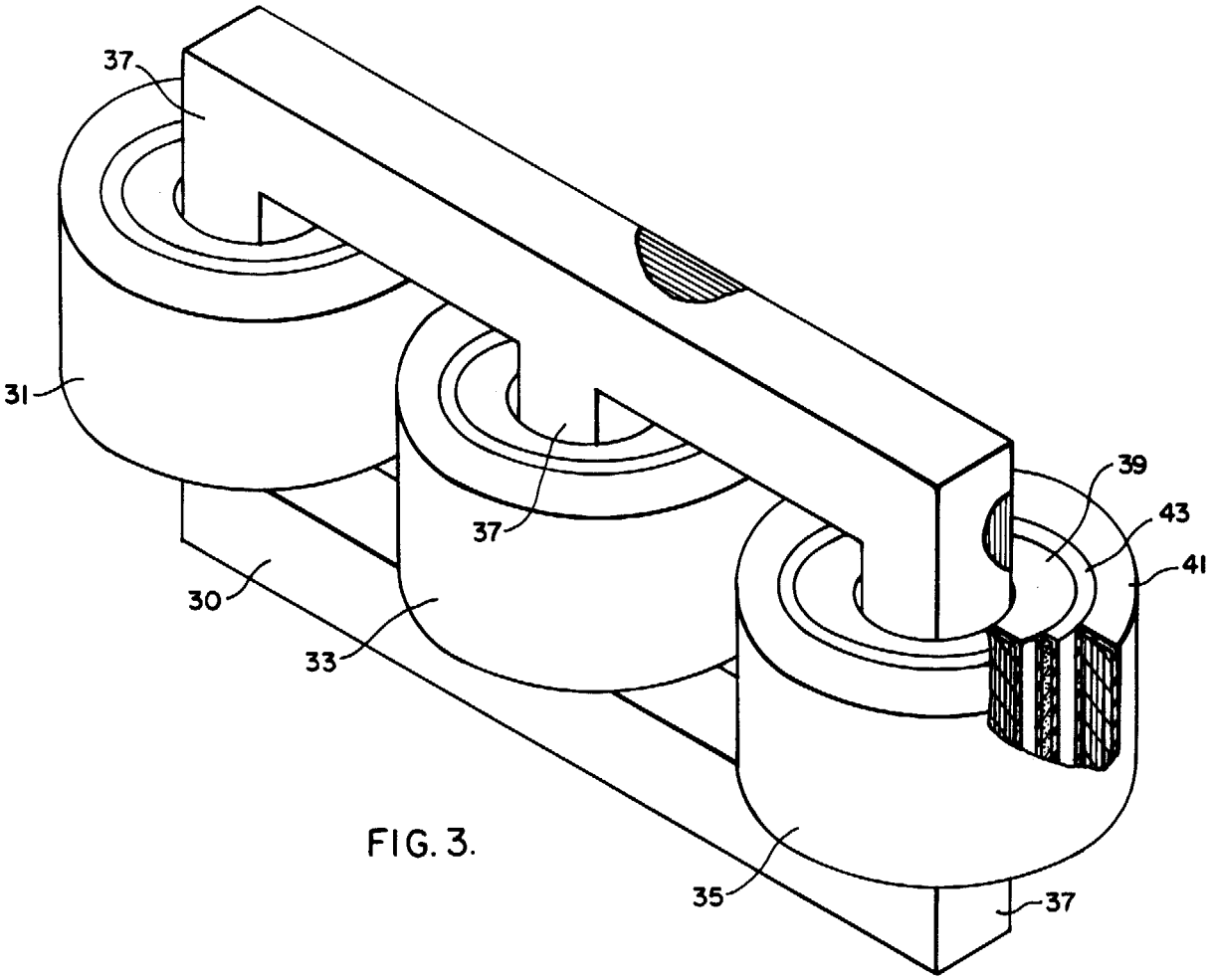
FIG. 3 is an isometric view of a core-type transformer as another embodiment of the invention.

Another embodiment of the invention is a coreform transformer generally indicated at 29 in FIG. 3. It comprises a core 30 and phases 31, 33, 35. The core 30 includes similar legs 37 around which the phases are disposed. The phases 31, 33, 35 are similar in construction and include, as shown for phase 35, a low-voltage winding 39 and a high-voltage winding 41. A shunt 43 is located between the windings 39, 41 and all three members 39, 41, 43 are concentrically disposed. The windings 39, 41 are comprised of a wound wire, or foil. The shunt 43 is an annulus comprised of magnetic material, such as microlaminations of a suitable ferromagnetic metal or alloy similar to that of shunts 21, 23. The shunt 43 is insulated from the windings 39, 41.

In addition, shunts are used in some high-low voltage groups to balance impedances as shown in FIGS. 4 and 5. Shunts may be added between sets of windings for multi-winding transformers, such as between tertiary and low-voltage windings or between tertiary and high-voltage windings, and not between other sets of windings. For example, in FIG. 4 a three-winding autotransformer comprising a pair of cores of which one core 45 is shown, as well as a group of windings including tertiary voltage windings 47, 49, high-voltage windings 51, and low-voltage windings 53 and shunt 55 is disposed between the low-voltage windings 53 and the tertiary voltage windings 49.

In another embodiment a group of six high-low voltage windings are shown. They include low-voltage windings 57, 59, 61, 63 and high-voltage windings 65, 67, 69, and 71. Shunt 73 is disposed between low-voltage coil 57 and high-voltage coil 65. Similarly, a shunt 75 is disposed between the high-voltage coil 71 and the low-voltage coil 63. Thus, shunts can be used wherever required to balance impedances among groups. Shunts are used in some high-low voltage coil areas, and not in others, in extreme cases where there would normally be a large unbalance in the current in separate parallel winding parts. For example, this could occur in a six high-low design (FIG. 5). Balanced impedances yield balanced currents in the parallel parts of windings, such as the tertiary voltage coil in FIG. 5 and the low-voltage coil in FIG. 5. Balanced currents yield minimum losses.

The invention is a transformer phase having suitable magnetic material placed between the windings as shown in the winding cross-section in FIG. 1. The magnetic material is used to adjust the impedance. The impedance of such a winding can be calculated by:

$$\text{Percent } IX = K\ AMT/VT^2\alpha\ (b_1\mu + b_2 + (a+c)/3),$$

where K is an empirical constant depending on the transformer power rating, frequency, and winding geometry, VT is the volts per turn, AMT is the average mean turn, $\alpha$ is the core opening width, $\mu$ is the relative permeability of the magnetic material, $b_1$ is the magnetic material thickness, $b_2$ is greater than or equal to the high-low space, a is the average length of a low voltage group, and c is the average length of a high voltage group. For a standard design, $b_1$ is zero, i.e., no magnetic material is placed in the high-low space.

The magnetic material assembly must be placed at every cross-section of the winding, but must not represent a complete conducting path around the core. This assembly must be properly insulated electrically and may be shielded with conducting materials and connected electrically to the winding to act as a static plate. The magnetic material should be laminated or made of small insulated chopped laminations (microlaminations) to reduce losses and heating.

In conclusion, the invention can be used in core or shell form transformers. In three winding transformers, different $b_1\mu$ combinations may be used between separate windings to give the required impedance relationships. It is also possible to balance currents in separate parallel windings by using different $b_1\mu$ values in different high-low spaces. The invention allows the possibility of standardizing windings because different impedances can be met with the same winding.

What is claimed is:

1. An electrical power transformer comprising:

a core member;

groups of sectioned low voltage windings and of high voltage windings which windings are inductively related to the core member;

a shunt of magnetic material between each group of low voltage windings and the high voltage windings; and each shunt comprising microlaminations of magnetic materials.

2. The transformer of claim 1 in which the shunts are insulated.

3. The transformer of claim 2 in which the low voltage windings comprise pancake coils disposed in two spaced coil-groups, and the high voltage windings comprise pancake coils disposed between the two spaced coil-groups.

4. The transformer of claim 3 in which the shunts are flat disc-like members disposed in spaces between the low and high voltage windings.

5. The transformer of claim 2 in which the low voltage and high voltage windings are concentrically disposed, and the shunt is a cylindrical member between the low and high voltage windings.

6. The transformer of claim 5 in which the high voltage winding surrounds the low voltage winding.

7. An electrical power transformer comprising:

a core member;

groups of sectioned low voltage windings and high voltage windings, which windings are inductively related to the core member;

a shunt of magnetic material between up to two groups of low and high voltage windings; and each shunt comprising microlaminations of magnetic materials.

8. An electrical power transformer comprising:

a core member;

a group of low and high voltage windings inductively related to the core member;

a tertiary voltage winding associated with at least one of the low voltage and high voltage windings; and a shunt of microlaminations of magnetic material between the tertiary voltage winding and one of the low voltage and high windings.

* * * * *